US008967982B2

(12) United States Patent
Durand et al.

(10) Patent No.: US 8,967,982 B2
(45) Date of Patent: Mar. 3, 2015

(54) MECHANICAL COOLANT PUMP

(75) Inventors: Jean-Michel Durand, Metz (FR); Achim Broemmel, Kempen (DE)

(73) Assignee: Pierburg Pump Technology GmbH, Neuss (DE)

( * ) Notice: Subject to any disclaimer, the term of this patent is extended or adjusted under 35 U.S.C. 154(b) by 261 days.

(21) Appl. No.: 13/577,910

(22) PCT Filed: Feb. 11, 2010

(86) PCT No.: PCT/EP2010/051706

§ 371 (c)(1), (2), (4) Date: Aug. 30, 2012

(87) PCT Pub. No.: WO2011/098126

PCT Pub. Date: Aug. 18, 2011

(65) Prior Publication Data

US 2012/0315160 A1 Dec. 13, 2012

(51) Int. Cl.
*F04D 15/02* (2006.01)
*F04D 15/00* (2006.01)

(52) U.S. Cl.
CPC ..... *F04D 15/0038* (2013.01)
USPC ..... 417/295

(58) Field of Classification Search
CPC ..... F04D 15/0038
USPC ..... 417/213, 289, 295; 415/131, 132, 140, 415/150, 151, 157, 208.1; 416/186 A
See application file for complete search history.

(56) References Cited

U.S. PATENT DOCUMENTS

| | | | | |
|---|---|---|---|---|
| 2,353,871 | A | 7/1944 | Bowen | |
| 2,459,815 | A * | 1/1949 | Hammell | 415/32 |
| 2,542,121 | A * | 2/1951 | Earl | 417/423.1 |
| 3,784,317 | A | 1/1974 | Lewis | |
| 4,752,183 | A | 6/1988 | Sakurai | |
| 4,929,150 | A * | 5/1990 | Daw | 415/157 |
| 7,963,749 | B1 * | 6/2011 | Mecozzi | 417/309 |
| 2007/0071617 | A1 * | 3/2007 | Orue | 417/423.1 |

FOREIGN PATENT DOCUMENTS

| | | |
|---|---|---|
| EP | 1 767 788 A1 | 3/2007 |
| FR | 1 093 898 A | 5/1955 |
| GB | 983 831 A | 2/1965 |

OTHER PUBLICATIONS

Navy Technical Disclosure Bulletin vol. 14, No. 2, Jun. 1989.*

* cited by examiner

*Primary Examiner* — Bryan Lettman
(74) *Attorney, Agent, or Firm* — Norman B. Thot

(57) ABSTRACT

A mechanical coolant pump for an internal combustion engine includes a main pump body configured to be stationary. A pump wheel is rotatably supported by the main pump body. The pump wheel comprises a central axial inlet opening. The pump wheel is configured to pump a coolant from the central axial inlet opening radially outwardly. A valve disk configured to be axially shiftable is arranged in the pump wheel. An actuator is configured to actuate the valve disk so as to close the central axial inlet opening in a closed position of the valve disk.

11 Claims, 2 Drawing Sheets

MECHANICAL COOLANT PUMP

CROSS REFERENCE TO PRIOR APPLICATIONS

This application is a U.S. National Phase application under 35 U.S.C. §371 of International Application No. PCT/EP2010/051706, filed on Feb. 11, 2010. The International Application was published in English on Aug. 18, 2011 as WO 2011/098126 A1 under PCT Article 21(2).

FIELD

The present invention relates to a mechanical coolant pump for an internal combustion engine.

BACKGROUND

A mechanical coolant pump is a coolant pump which is driven by the combustion engine, for example, by using a driving belt driving a driving wheel of the pump. As long as the combustion engine is cold, only a minimum coolant flow is needed. Therefore, mechanical coolant pumps are used which can vary the capacity of the coolant flow rate. As long as the combustion engine is cold, the flow rate is minimized, with the result that the combustion engine warming-up phase is shortened.

A mechanical coolant pump of the prior art which is able to vary the capacity of the coolant flow rate is disclosed in U.S. Pat. No. 4,752,183. The pump comprises a housing and a rotor shaft on which a pump wheel is mounted, whereby the pump wheel pumps the coolant radially outwardly. The pump wheel comprises a base disk and a separate valve disk. The base disk is provided with an axial inlet opening and is fixed on the rotor shaft. The valve disk is arranged separately on a disk shaft, whereby the disk shaft is incorporated into the rotor shaft and is axially movable so that the pump wheel can vary the coolant flow rate by varying the axial distance between the base disk and the valve disk, i.e., the radial outlet opening of the pump wheel. The rotor shaft on which the base disk is mounted is in the inlet area of the pump so that the rotor shaft is provided with a significant flow resistance for the coolant which is sucked axially by the pump wheel. This flow resistance causes turbulence in the coolant flow so that the energy consumption of the pump is high even when the pump is pumping with a minimal flow rate.

SUMMARY

An aspect of the present invention is to provide a mechanical coolant pump with a decreased flow resistance.

In an embodiment, the present invention provides a mechanical coolant pump for an internal combustion engine which includes a main pump body configured to be stationary. A pump wheel is rotatably supported by the main pump body. The pump wheel comprises a central axial inlet opening. The pump wheel is configured to pump a coolant from the central axial inlet opening radially outwardly. A valve disk configured to be axially shiftable is arranged in the pump wheel. An actuator is configured to actuate the valve disk so as to close the central axial inlet opening in a closed position of the valve disk.

BRIEF DESCRIPTION OF THE DRAWINGS

The present invention is described in greater detail below on the basis of embodiments and of the drawings in which.

DETAILED DESCRIPTION

Figure 1B:
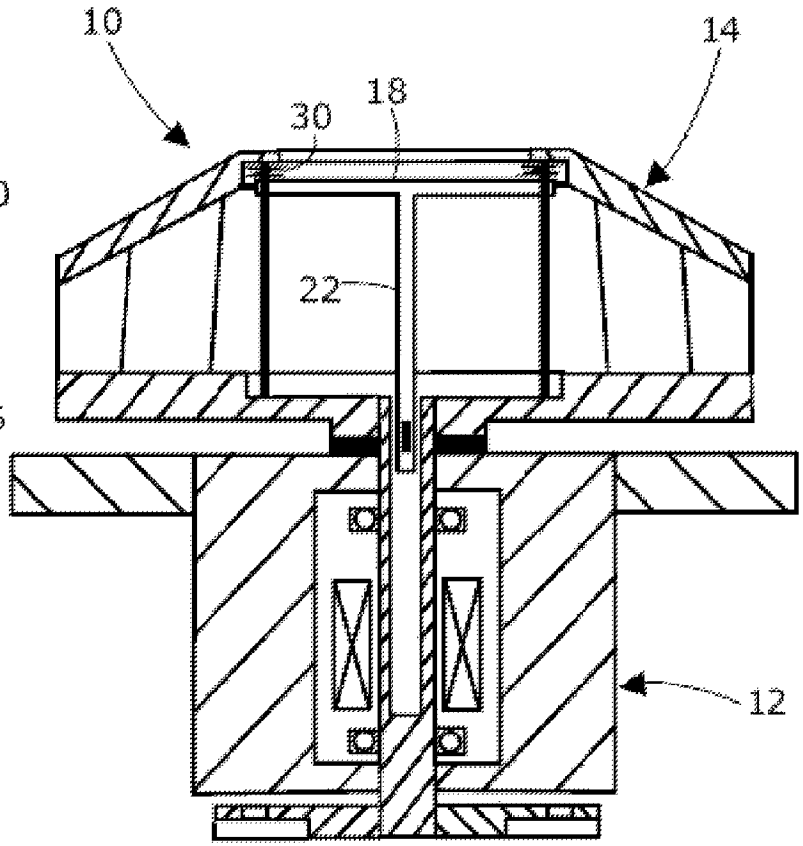
FIG. 1*a* and FIG. 1*b* show a sectional view of a mechanical coolant pump in an open and closed position.

The mechanical coolant pump for an internal combustion engine according to the present invention comprises a stationary main pump body and a pump wheel rotatably supported by the main pump body. The pump wheel is an impeller which comprises a base disk and pump blades. The coolant pump is provided with a central axial inlet opening. The pump wheel pumps the coolant from the inlet opening radially outwardly. The pump wheel is provided with an axially shiftable valve disk being actuated by an actuator and closing the axial inlet opening in the closed position of the valve disk, i.e., the distal valve disk position. In the open valve disk position, the valve disk is positioned at the proximal axial end of the pump wheel.

The fact that the pump wheel is rotatably supported by the main pump body in combination with the axial inlet opening which is closable by the axially shiftable valve disk provides a coolant pump with a minimized flow resistance, especially without a flow resistance in the inlet area when the valve disk is in the open position. This construction of a pump furthermore provides a universal solution of a coolant pump, i.e., a controllable coolant pump which can be adapted with or without a volute and/or with or without a complete housing to all potential combustion engines. A housing is not required because the valve is integrated into the pump wheel.

In an embodiment of the present invention, the pump wheel can, for example, be attached to a rotor shaft and the rotor shaft can, for example, be rotatably supported by the main pump body.

In an embodiment of the present invention, the valve disk can, for example, be attached to a disk shaft and the disk shaft can be provided with a permanent magnet. By activating a stationary electromagnetic coil, the permanent magnet at the disk shaft is attracted or repulsed by the magnet. This is a simple actuator which allows a contact-free, fluid-tight and continuous actuation of the valve disk.

In an embodiment of the present invention, the rotor shaft can, for example, be provided with an axial cylindrical recess, whereby the disk shaft is guided axially in the cylindrical recess. The cylindrical recess supports the axial guiding disk shaft and allows the shifting of the valve disk between the open position and the closed position.

In an embodiment of the present invention, the pump wheel can, for example, be provided with a distal cover ring and the axial inlet opening is the central opening of the cover ring. The cover ring together with the pump blades forms an impeller which sucks in the coolant axially through the central opening of the cover ring. Further, the cover ring is an axial stop for the valve disk when the valve disk is in the closed position.

In an embodiment of the present invention, the valve disk can, for example, be pre-tensioned by a push spring and the valve disk can be pushed into the open position by the pre-tension push spring. The push spring can be a compression spring which is arranged in a circular recess of the cover ring. The push spring is supported at the distal side of the valve disk. The recess in the cover ring provides a minimal gap between the valve disk in the closed position and the cover ring, the gap being as small as possible so that the axial inlet opening is closeable approximately fluid-tight. The push spring furthermore makes the pump fail-safe in case of a power loss of the actuator.

In an embodiment of the present invention, the valve disk is pretensioned by a pull spring and the valve disk is pulled into the open position by the pretension pull spring. The spring can be arranged in a recess in the base disk and can be fixed at the proximal side of the valve disk so that the valve disk is pulled into the open position by the pull spring.

In an embodiment of the present invention, the pull spring is arranged in the axial cylindrical recess of the rotor shaft so that the disk shaft is pulled by the spring. By pulling the disk shaft, the valve disk is pulled into the open position. This alternative arrangement of the pull spring makes it possible to provide a pump wheel which does not require any guiding element for the spring.

In an embodiment of the present invention, the pump wheel can, for example, be provided with at least one axial guiding element for guiding the valve disk axially, whereby the guiding element is positioned between the cover ring and a base disk. The guiding element is supporting the valve disk during the axial shift between the open position and the closed position. The guiding element can be realized as an axial rod, a slit or a rail.

In an embodiment of the present invention, the spring can, for example, be arranged coaxially with the guiding element, if the guiding element is an axial rod. The coaxial arrangement of both elements, i.e., the guiding element and the spring, minimizes the flow resistance of the coolant flow through the pump wheel.

In an embodiment of the present invention, the actuator can, for example, be an electromagnetic actuator. The actuator can alternatively be a thermostatic, pneumatic or hydraulic element. An electromagnetic actuator makes it possible to control the disk shaft independently of the temperature of the coolant. The electromagnetic actuator can furthermore be arranged in the main pump body fluid-tight so that a contact-free actuation of the valve disk or of the disk shaft is possible. The electromagnetic actuator allows a positioning of the valve disk at intermediate positions.

In an embodiment of the present invention, the rotor shaft and the disk shaft can be made out of a non-ferromagnetic material. This makes it possible to actuate the disk shaft with an electromagnetic actuator when the disk shaft is provided with a permanent magnet.

FIG. 1 shows a mechanical coolant pump 10 for an internal combustion engine. The mechanical coolant pump 10 comprises a stationary main pump body 12 and a pump wheel 14 which is rotatably supported by the main pump body 12. The pump wheel 14 pumps the coolant from an inlet opening 16 of the pump wheel 14 radially outwardly.

The mechanical coolant pump 10 is mounted directly to an engine block of an internal combustion engine by a flange 48 or can have an additional housing part which is not shown.

The pump wheel 14 comprises a base disk 36, numerous blades 40 which are fixed to the distal side of the base disk 36 and a cover ring 28 which is arranged at the distal end of the blades 40. The cover ring 28 is provided with a central axial inlet opening 16. The pump wheel 14 comprises a valve disk 18 which is axially shiftable and closes the axial inlet opening 16 in the closing position, as can be seen in FIG. 1*b*.

The valve disk 18 is positioned in a ring recess 50 of the base disk 36 when the valve disk 18 is in the open position so that the distal sides of the valve disk 18 and of the base disk 36 are lying in one plane.

The stationary main pump body 12 supports a rotatable rotor shaft 20 which is driven by the combustion engine via a driving belt (not shown) which drives a driving wheel 42 being connected with the rotor shaft 20 which is connected with the pump wheel 14. The rotor shaft 20 is made out of a non-ferromagnetic material. The driving wheel 42 is arranged, with respect to the pump wheel 14, at the opposite axial end of the main pump body 12 and is connected directly to the rotor shaft 20. The rotor shaft 20 is rotatably supported by two rotor shaft bearings 44 which are arranged at both axial sides of an electromagnetic actuator 38 in the main pump body 12. The bearings 44 can be any kind of bearings which are known to the person skilled in the art.

The actuator 38 can, for example, be an electromagnetic ring coil positioned between the bearings 44. The actuator 38 actuates the valve disk 18. The valve disk 18 is attached to a disk shaft 22 and a permanent magnet 24 is provided at the axially distal end of the disk shaft 22, i.e., with respect to the valve disk 18 at the opposite end of the disk shaft 22. The disk shaft 22 is made out of a non-ferromagnetic material. The disk shaft 22 is arranged and guided in an axial cylindrical recess 26 which is provided in the rotor shaft 20.

The valve disk 18 is also guided by an axially orientated guiding element 34 which is a rod. The guiding element 34 is positioned between the cover ring 28 and the base disk 36 of the pump wheel 14. The guiding element 34 axially guides the valve disk 18 between the open position (FIG. 1*a*) and the closed position (FIG. 1*b*).

Figure 1A:
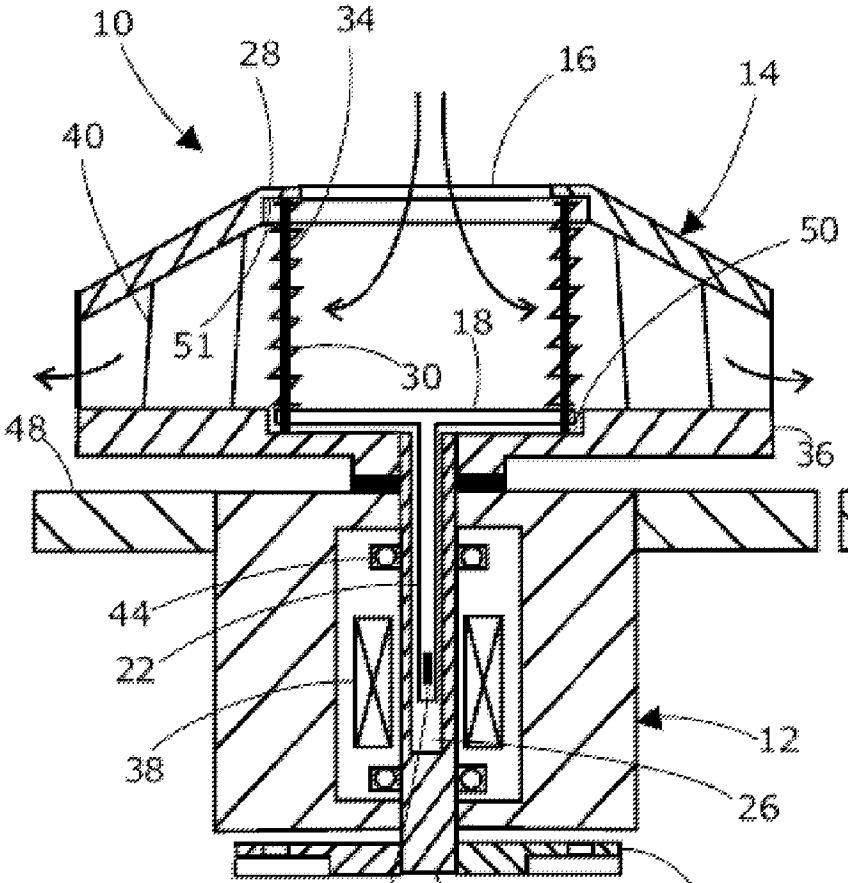

A push spring 30 is arranged coaxially with the guiding element 34. The push spring 30 is a compression spring which is arranged in a ring recess 51 of the cover ring 28. The push spring 30 pushes the distal side of the valve disk 18 into the open position as shown in FIG. 1*a* when the actuator 38 is inactivated. This arrangement makes the pump 10 fail-safe in case of a power loss of the actuator 38. When the actuator 38 is activated, the valve disk 18 is actuated so that the valve disk 18 is shifted into the closed position as can be seen in FIG. 1*b* or can be shifted into an intermediate position (not shown) so that the coolant flow rate of the pump can be varied.

Figure 2:
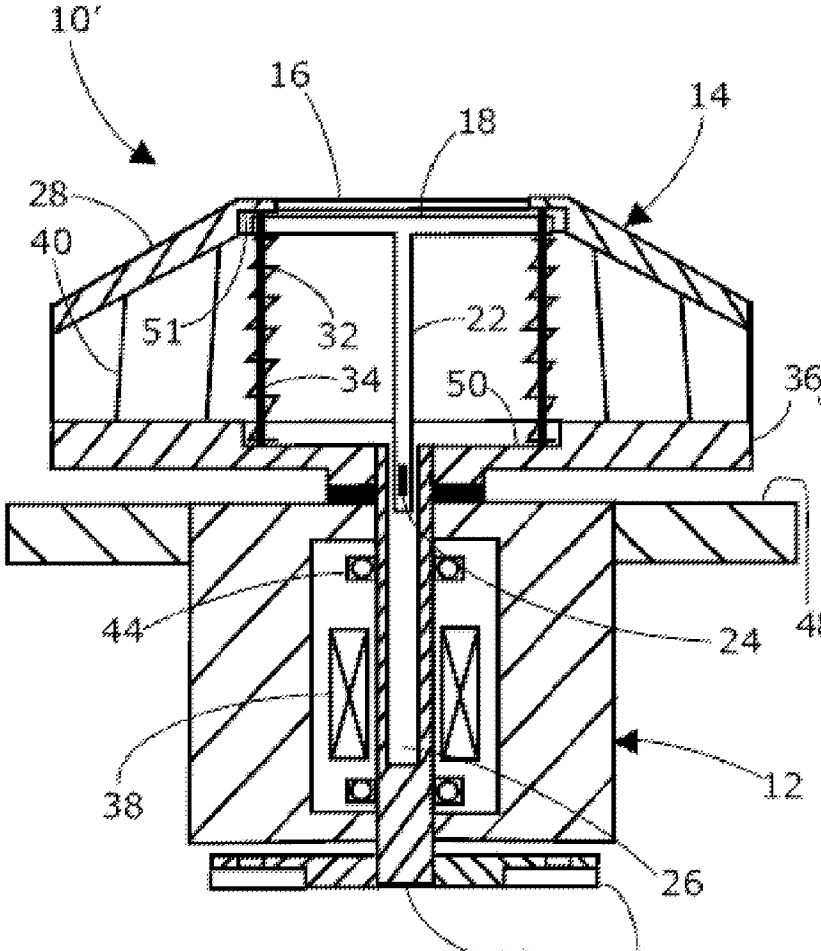
FIG. 2 shows an embodiment of the mechanical coolant pump in the closed position.

FIG. 2 shows an embodiment of a mechanical coolant pump 10' in the closed position, whereby the valve disk 18 is pre-tensioned by a pull spring 32 so that the valve disk 18 is pulled into the open position (not shown) by the pull spring 32. The pull spring 32 is arranged in a ring recess 50 of the base disk 36 and at the proximal side of the valve disk 18 so that the valve disk 18 is pulled into the open position. The pull spring 32 is arranged coaxially with the guiding element 34.

Figure 3:
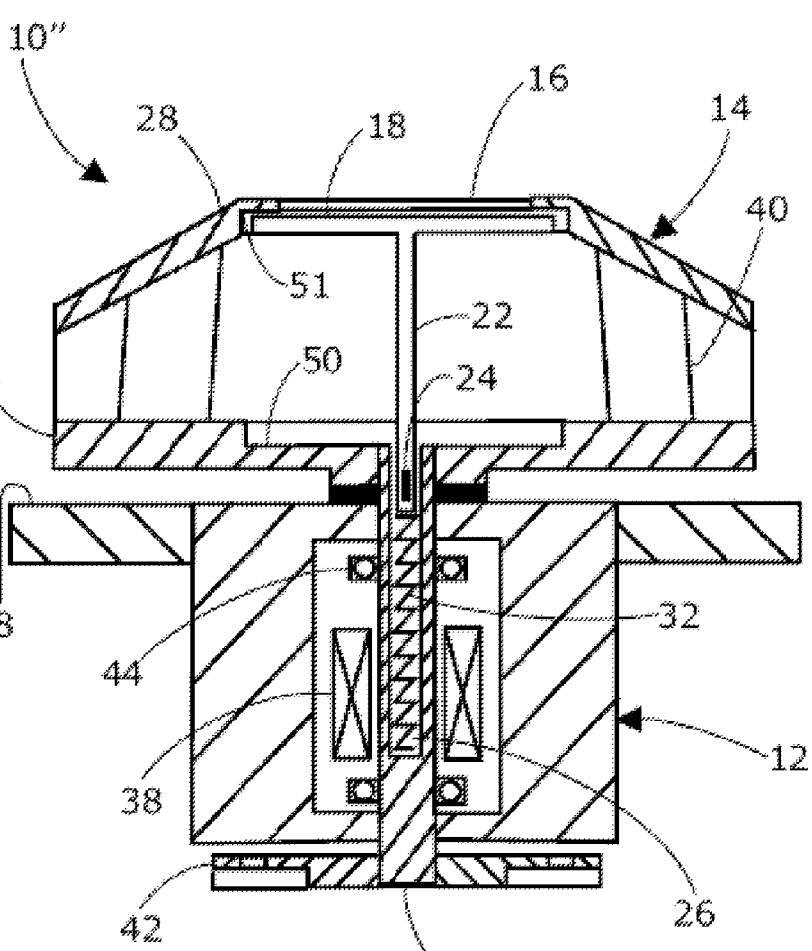
FIG. 3 shows an embodiment of the mechanical coolant pump in the closed position.

FIG. 3 shows an embodiment of a mechanical coolant pump 10" in the closed position of the pump wheel 14, whereby the valve disk 18 is pre-tensioned by a pull spring 32 so that the valve disk 18 is pulled into the open position (not shown) by the pull spring 32. The pull spring 32 is arranged inside the axial cylindrical recess 26 of the rotor shaft 20 and is connected to the disk shaft 22. By pulling the disk shaft 22, the valve disk 18 is pulled into the open position (not shown).

This arrangement of the pull spring 32 makes it possible to provide a pump wheel 14 which does not require the spring guiding element 34 (FIG. 2). The valve disk 18 is guided via the disk shaft 22 in the axial cylindrical recess 26 of the rotor shaft 20 between the open position (not shown) and the closed position, as shown in FIG. 3.

The present invention is not limited to embodiments described herein; reference should be had to the appended claims.

What is claimed is:

1. A mechanical coolant pump for an internal combustion engine, the mechanical coolant pump comprising:

a main pump body configured to be stationary;

a pump wheel rotatably supported by the main pump body, the pump wheel comprising a central axial inlet opening and a distal cover ring, the pump wheel being configured to pump a liquid coolant from the central axial inlet opening radially outwardly;

a valve disk configured to be axially shiftable arranged in the pump wheel; and an actuator configured to actuate the valve disk so as to close the central axial inlet opening in a closed position of the valve disk, wherein, the central axial inlet opening is a central opening of the distal cover ring, and the central axial inlet opening is closed so as to be approximately fluid-tight in the closed position of the valve disk.

2. The mechanical coolant pump as recited in claim 1, further comprising a rotor shaft, wherein the pump wheel is attached to the rotor shaft and the rotor shaft is rotatably supported by the main pump body.

3. The mechanical coolant pump as recited in claim 2, wherein the rotor shaft is made out of a non-ferromagnetic material.

4. The mechanical coolant pump as recited in claim 2, further comprising a disk shaft, wherein the rotor shaft comprises an axial cylindrical recess, and wherein the disk shaft is configured to be axially guided in the axial cylindrical recess.

5. The mechanical coolant pump as recited in claim 4, wherein the disk shaft is made out of a non-ferromagnetic material.

6. The mechanical coolant pump as recited in claim 4, wherein the disk shaft further comprises a permanent magnet, and wherein the valve disk is attached to the disk shaft.

7. The mechanical coolant pump as recited in claim 1, further comprising a push spring, wherein the valve disk is configured to be pretensioned and to be pushed into an open position by the push spring.

8. The mechanical coolant pump as recited in claim 1, further comprising a pull spring configured to be pretentioned, wherein the valve disk is configured to be pretensioned and to be pulled into an open position by the pull spring.

9. The mechanical coolant pump as recited in claim 1, further comprising a cover ring and a base disk, wherein the pump wheel further comprises at least one axial guiding element configured to axially guide the valve disk, the at least one axial guiding element being arranged between the cover ring and the base disk.

10. The mechanical coolant pump as recited in claim 9, further comprising at least one of a push spring and a pull spring, wherein the valve disk is configured to be pretensioned and to be biased into an open position by at least one of the push spring and the pull spring, and wherein the at least one of the push spring and the pull spring is arranged longitudinally along with the at least one axial guiding element.

11. The mechanical coolant pump as recited in claim 1, wherein the actuator is an electromagnetic actuator.

* * * * *